US009066631B2

(12) United States Patent
Didehvar et al.

(10) Patent No.: US 9,066,631 B2
(45) Date of Patent: Jun. 30, 2015

(54) UTILITY TUB

(75) Inventors: Kaveh Didehvar, Hockessin, DE (US); Joseph Vaccaro, West Chester, PA (US); Joseph Webb, Newark, DE (US)

(73) Assignee: Zenith Products Corporation, New Castle, DE (US)

( * ) Notice: Subject to any disclaimer, the term of this patent is extended or adjusted under 35 U.S.C. 154(b) by 900 days.

(21) Appl. No.: 13/253,168

(22) Filed: Oct. 5, 2011

(65) Prior Publication Data

US 2013/0086742 A1 Apr. 11, 2013

(51) Int. Cl.
*A47K 1/04* (2006.01)
*A47K 1/02* (2006.01)

(52) U.S. Cl.
CPC ..... *A47K 1/02* (2013.01)

(58) Field of Classification Search
CPC ..... A47K 1/00; A47K 1/09; A47K 1/04; A47K 1/02; A47K 1/08; D06F 1/02; A47J 47/20
USPC ..... 4/656, 630, 654, 625–627
See application file for complete search history.

(56) References Cited

U.S. PATENT DOCUMENTS

| | | | | |
|---|---|---|---|---|
| 208,094 | A | 9/1878 | Higgins | |
| 1,409,942 | A * | 3/1922 | Garniss | 4/549 |
| 3,129,436 | A | 4/1964 | Mustee | |
| D208,395 | S | 8/1967 | Mustee | |
| 3,333,282 | A | 8/1967 | Mustee | |
| 3,384,230 | A | 5/1968 | Mustee | |
| D223,667 | S | 5/1972 | DiPierro et al. | |
| 3,775,779 | A | 12/1973 | Kohler | |
| 4,746,088 | A | 5/1988 | Kruger | |
| 5,502,848 | A * | 4/1996 | Cowan | 4/619 |
| 5,715,547 | A * | 2/1998 | Becker et al. | 4/619 |
| 5,722,560 | A | 3/1998 | Mustee et al. | |
| D464,715 | S | 10/2002 | Zarker | |
| 6,494,419 | B2 * | 12/2002 | Pai | 248/127 |
| D583,445 | S | 12/2008 | Lee et al. | |
| D602,136 | S | 10/2009 | Lee et al. | |
| 2009/0100591 | A1 | 4/2009 | Lee et al. | |

* cited by examiner

*Primary Examiner* — Janie Christiansen
(74) *Attorney, Agent, or Firm* — Panitch Schwarze Belisario & Nadel LLP

(57) ABSTRACT

A utility tub includes a basin having a bottom wall and a sidewall extending generally perpendicularly therefrom. At least two legs support the basin above a supporting surface. Each of the at least two legs extends generally perpendicularly with respect to the bottom wall of the basin and the supporting surface. A shelf includes a top surface and an opposing bottom surface. The shelf is selectively removably detachable to the basin and each of the at least two legs such that the shelf has a first configuration wherein a least a portion of the shelf is supported within the basin above the bottom wall and the second configuration wherein at least a portion of the shelf is supported by the at least two legs below the bottom wall of the basin.

17 Claims, 5 Drawing Sheets

UTILITY TUB

BACKSUPPORTING OF THE INVENTION

The present invention relates generally to a utility tub and, more particularly, to a household or commercial washbasin and support structure for use with a faucet and designed to provide additional storage for various items, such as toiletries.

Utility tubs are well known. Conventional utility tubs provide a basin that is sized and shaped to receive and temporarily store water flowing from a faucet and/or household or commercial items, such as wash buckets or paint cans, therein. Conventional utility tubs are useful for washing or temporarily storing items, but lack additional features that would improve the versatility and usability of the utility tub.

Therefore, it would be desirable to create a utility tub that improves upon the characteristics of conventional utility tubs. For example, it would be desirable to create a utility tub that provides additional storage for a variety of household or commercial items. More specifically, it would be desirable to create a utility tub having a removable shelf that is repositionable between a configuration within the basin and a configuration beneath the basin. It would also be desirable to provide a utility tub having removable legs for ease of storage and/or shipment, and a removable dish that may be used in conjunction with a hose of a faucet for supporting various items in or above the basin. The present invention accomplishes the above objectives.

BRIEF SUMMARY OF THE INVENTION

Briefly stated, one aspect of a preferred embodiment of the present invention is directed to a utility tub including a basin having a bottom wall and a sidewall extending generally perpendicularly therefrom. At least two legs support the basin above a supporting surface. Each of the at least two legs extends generally perpendicularly with respect to the bottom wall of the basin and the supporting surface. A shelf includes a top surface and an opposing bottom surface. The shelf is selectively removably detachable to the basin and each of the at least two legs such that the shelf has a first configuration wherein a least a portion of the shelf is supported within the basin above the bottom wall and the second configuration wherein at least a portion of the shelf is supported by the at least two legs below the bottom wall of the basin.

In another aspect, a preferred embodiment of the present invention is directed to a utility tub including a basin having a front sidewall, an opposing rear sidewall, a left sidewall, an opposing right sidewall, and a bottom wall. Each of the sidewalls extend generally perpendicularly with respect to the bottom wall. Each pair of adjacent sidewalls forms a corner of the basin. A dish is selectively removably mountable within either of at least two of the corners of the basin. The dish has a top surface, an opposing bottom surface and at least one opening extending therethrough. The opening is sized and shaped to receive at least a portion of a hose therethrough.

BRIEF DESCRIPTION OF THE SEVERAL VIEWS OF THE DRAWINGS

The foregoing summary, as well as the following detailed description of the preferred embodiment of the present invention, will be better understood when read in conjunction with the appended drawings. For the purpose of illustrating the invention, there is shown in the drawings an embodiment which is presently preferred. It should be understood, however, that the present invention is not limited to the precise arrangements and instrumentalities shown. In the drawings.

DETAILED DESCRIPTION OF THE INVENTION

Figure 1:
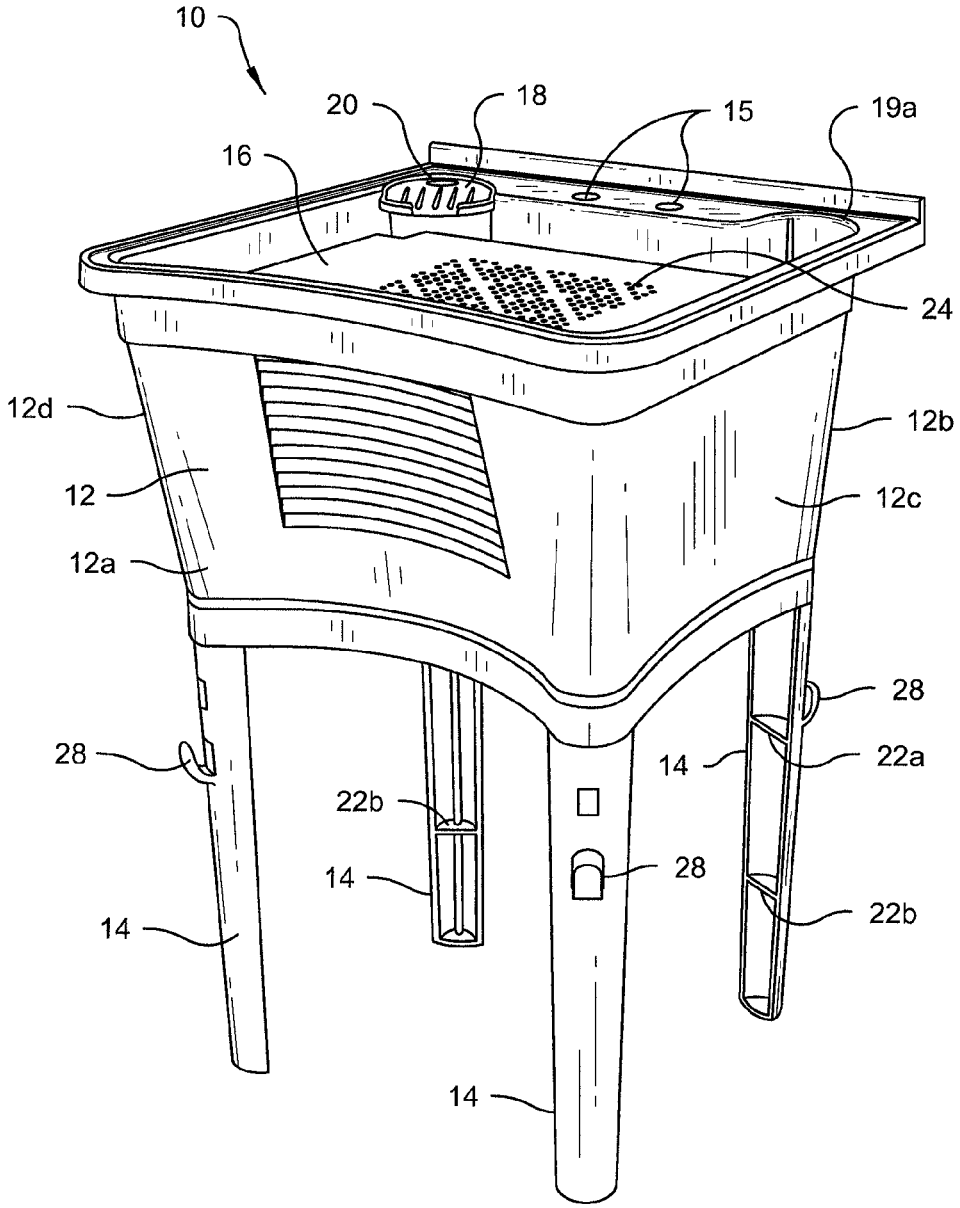
FIG. 1 is a perspective view of a utility tub in accordance with a preferred embodiment of the present invention, wherein a support shelf is shown in a first configuration.

Certain terminology is used in the following description for convenience only and is not limiting. The words "right," "left," "lower," "bottom," "upper," "top," "front" and "rear" designate directions in the drawings to which reference is made, and refer to directions with respect to the geometric center of the utility tub. The words "inwardly," "outwardly," "interior" and "exterior" refer to directions toward and away from, respectively, the geometric center of the utility tub, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Figure 2:
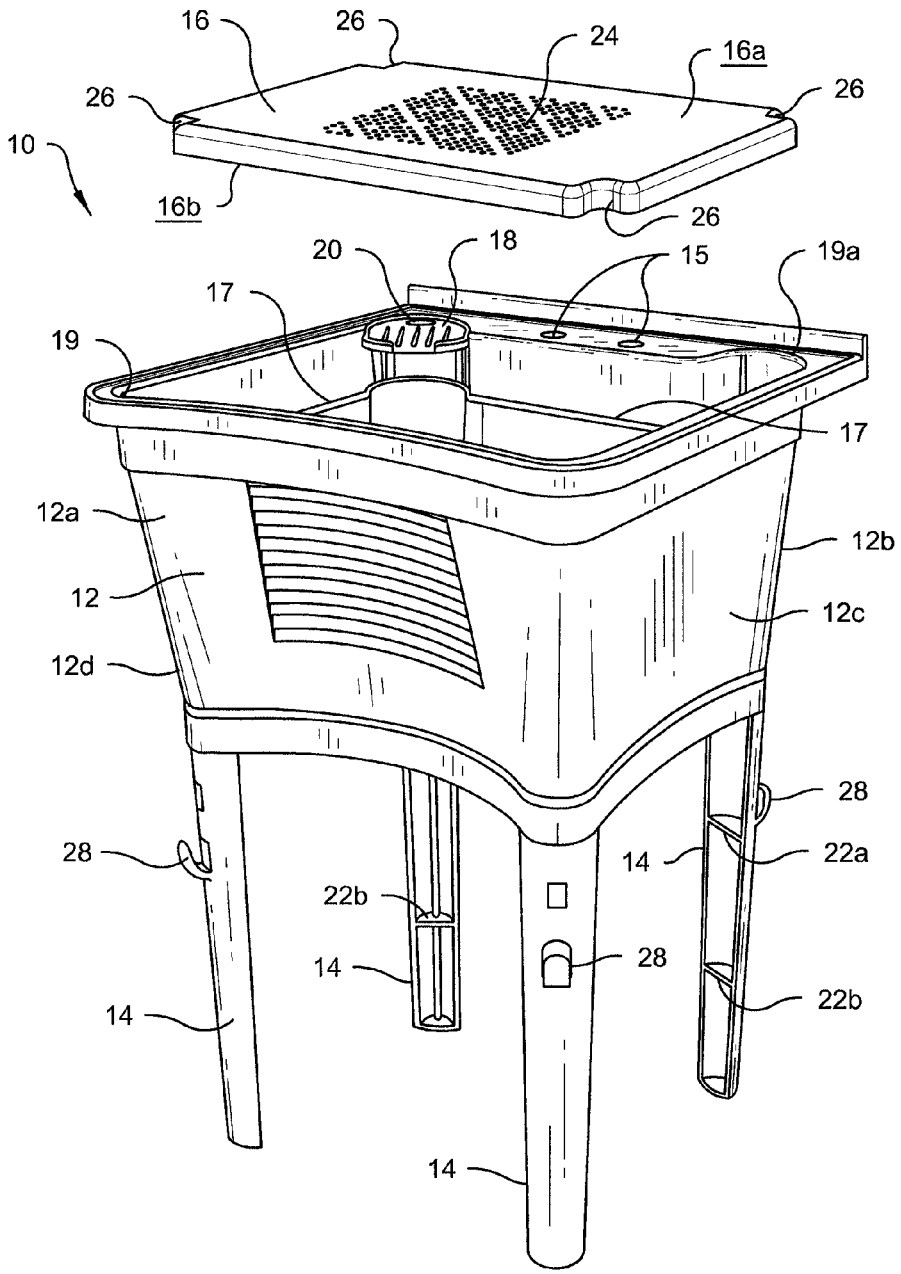
FIG. 2 is a partially exploded perspective view of the utility tub of FIG. 1, wherein the support shelf is shown spaced-above the first configuration.
Figure 3:
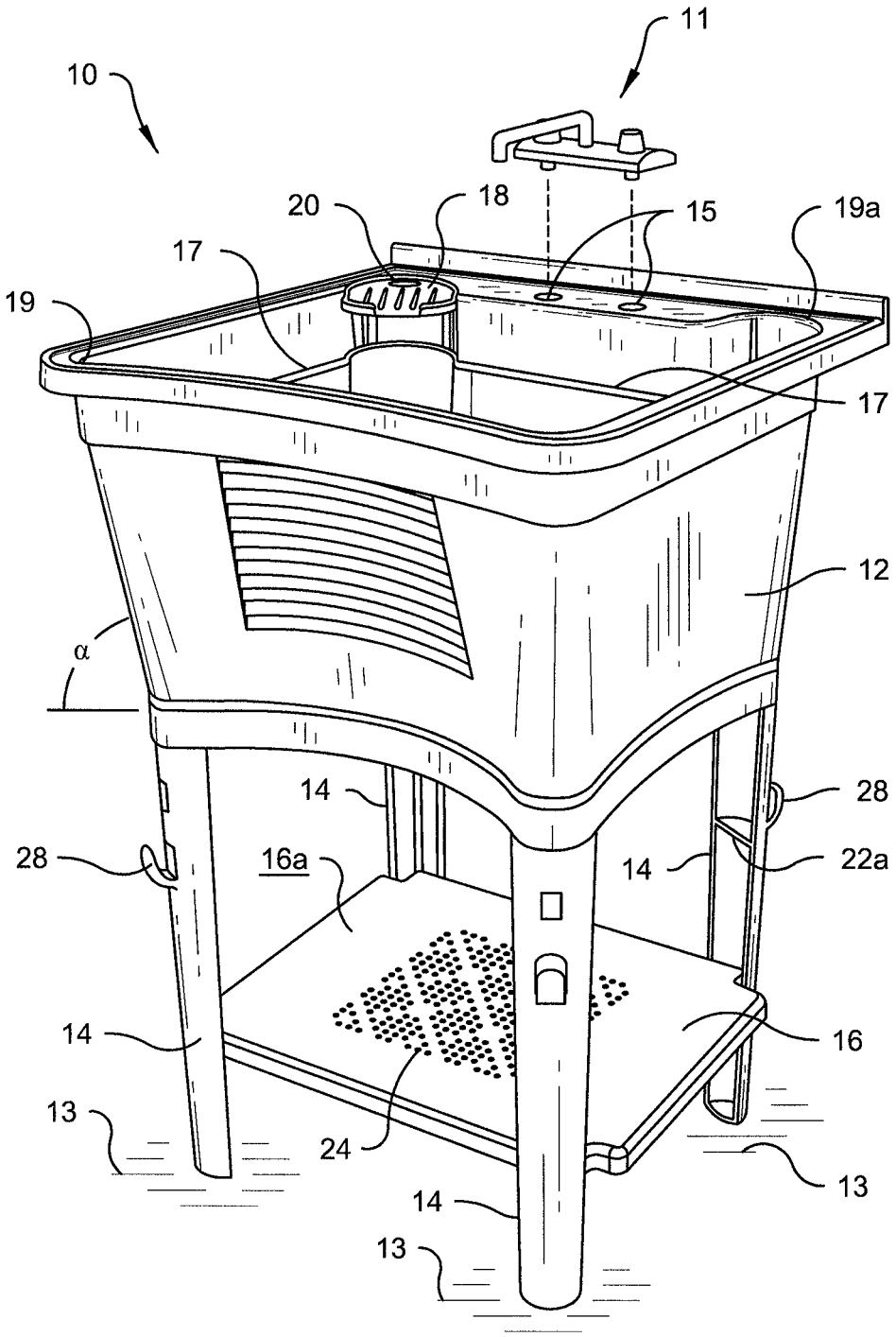
FIG. 3 is a partially exploded perspective view of the utility tub of FIG. 1, wherein the support shelf is shown in a second configuration and a faucet is shown in a raised configuration.
Figure 4:
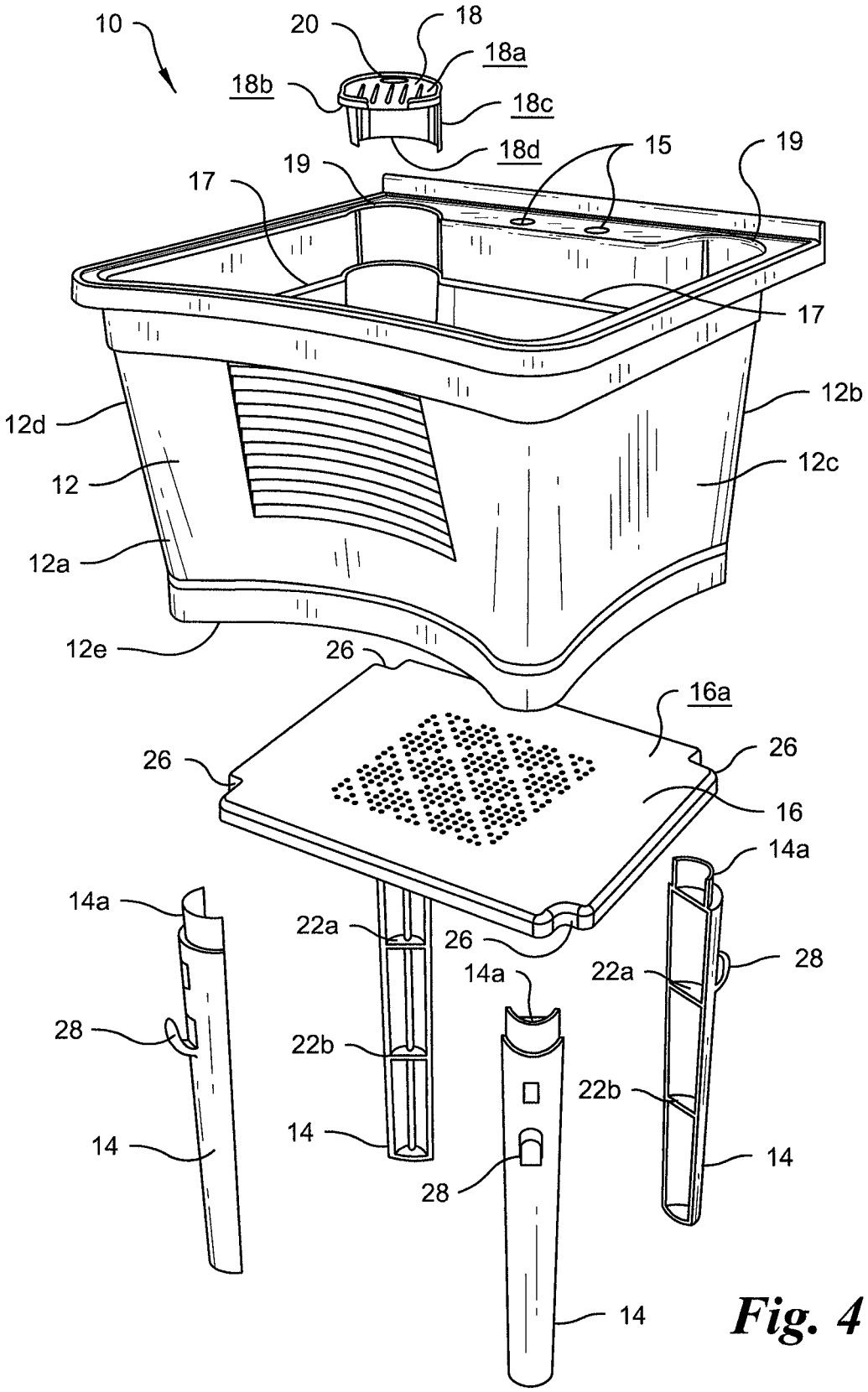
FIG. 4 is a partially exploded view of the utility tub of FIG. 1.
Figure 5:
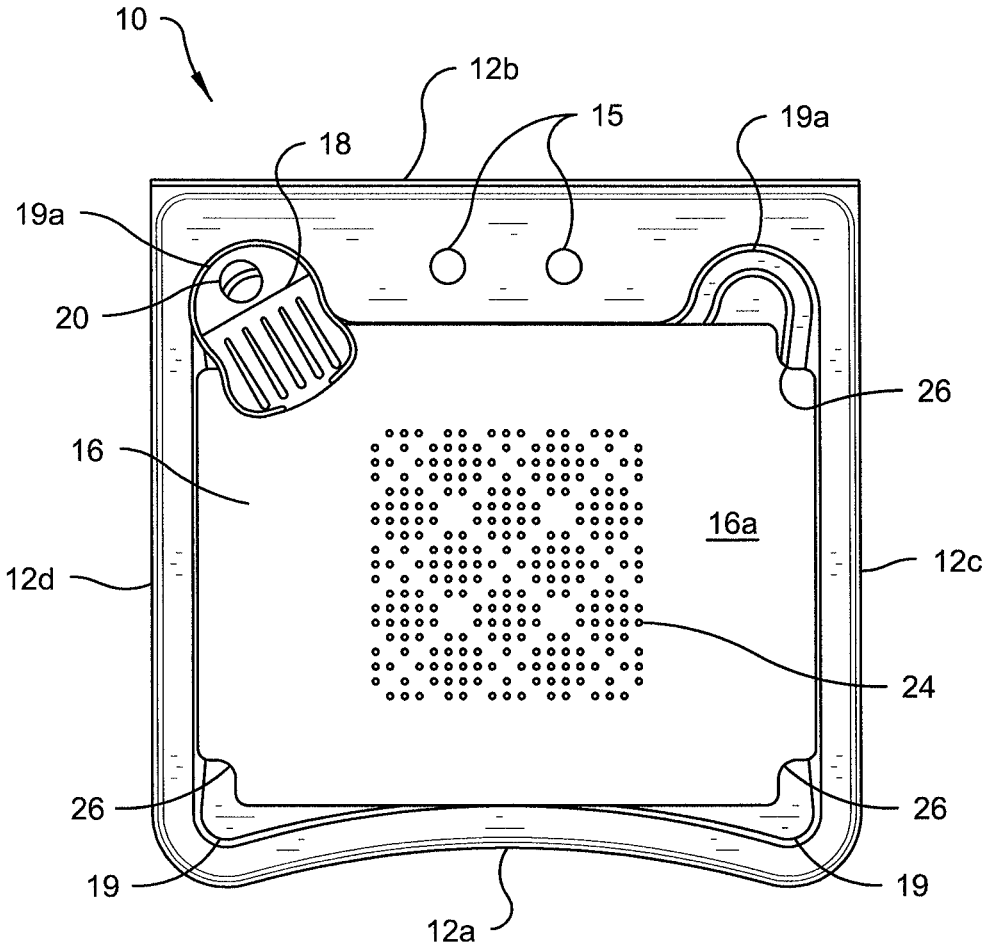
FIG. 5 is a top plan view of the utility tub of FIG. 1, wherein the support shelf is shown in the first configuration.

Referring to the drawings in detail, wherein like numerals indicate like elements throughout the several views, FIGS. 1-5 show a utility tub, generally designated 10, for use with a faucet or spigot 11 (see FIG. 3) and designed to provide additional storage for household and/or commercial items, such as toiletries, wash buckets, paint cans, paint brushes or the like (none shown). The utility tub 10 is preferably free-standing, such that it does not require support from an adjacent wall or structure. In addition, it is preferred that the utility tub 10 requires no mounting hardware, such as bolts or screws (none shown), such that the various components of the utility tub 10 are connectable or attachable without mounting hardware. However, it is understood that mounting hardware may be used to further securely assembly various portions of the utility tub 10, or to securely attach the utility tub 10 directly to an adjacent wall, for example. It is preferred that the utility tub 10 is shipped to a consumer or retailer in an unassembled state (such as shown in FIG. 4), and is then assembled by a user or consumer, for example. However, it is understood that the utility tub 10 may be preassembled and shipped and/or stored in an assembled state (see FIG. 1). Each of the various components of the utility tub 10 are preferably formed and/or molded of a polymeric material, but the present invention is not so limited.

Referring to FIGS. 1-5, the utility tub 10 preferably includes a basin 12 for receiving and/or at least temporarily holding liquid, such as water from the faucet 11 and/or household or commercial items such as wash buckets or paint cans. The basin 12 preferably includes a bottom wall 12*e* and a sidewall 12*a*, 12*b*, 12*c*, 12*d* extending generally perpendicularly therefrom. The bottom wall 12*e* and the sidewall 12*a*, 12*b*, 12*c*, 12*d* generally define a cavity. More specifically, the basin 12 preferably includes a first or front sidewall 12*a*, a second or opposing rear sidewall 12*b*, a third or right lateral sidewall 12*c* and an opposing fourth or left lateral sidewall 12*d*. The front and rear sidewalls 12*a*, 12*b* generally each define a plane, and the planes of the front and rear sidewalls 12*a*, 12*b* extend generally parallel to one another. Similarly, the right and left lateral sidewalls 12*c*, 12*d* each define a plane, and the planes of the right and left lateral sidewalls 12*c*, 12*d* extend generally parallel to one another. Further, the plane defined by the front sidewall 12*a* extends generally perpendicularly to the plane defined by the left sidewall 12*c*. As shown in FIG. 3, each sidewall 12*a*, 12*b*, 12*c*, 12*d* extends at an angle α, such as approximately seventy five degrees (75°), with respect to a plane defined by the bottom wall 12*e* of the base 12.

Each sidewall 12*a*, 12*b*, 12*c*, 12*d* preferably includes a lower end, which is integrally, unitarily and/or monolithically formed with and/or attached to at least a portion of an outer periphery of the bottom wall 12*e*, and an opposing upper end, which defines an upper rim of the basin 12. A drainage hole (not shown) is preferably formed and extends through the bottom wall 12*e*. A removable plug (not shown) may be received in the drainage hole to prevent liquid from flowing therethrough. At least a portion of the faucet 11 is removably mountable in two spaced-apart openings or passageways 15 in the upper rim of the basin 12. Each pair of adjacent sidewalls 12*a*, 12*b*, 12*c*, 12*d* preferably forms a corner 19 of the basin 12, such that the basin 12 has four spaced-apart generally curved corners 19 that preferably extend the entire height of the basin 12.

As shown in FIGS. 2-4, each sidewall 12*a*, 12*b*, 12*c*, 12*d* includes an inwardly-extending ledge 17 proximate the upper end thereof. The ledge 17 preferably defined a plane that extends generally, if not exactly, parallel to the plane defined by the bottom wall 12*e* of the basin 12. As is apparent from each of FIGS. 1-5, at least a portion of each of the front, right and left sidewalls 12*a*, 12*c*, 12*d* of the basin 12, such an interior surface thereof, are preferably at least partially convex with respect to a geometric center of the basin 12. In contrast, the rear sidewall 12*b* is preferably flat or planar for abutting and/or directly contacting a flat or planar wall of a room or building, for example.

Referring to FIGS. 1-4, the utility tub 10 preferably includes at least two and preferably four spaced-apart legs 14 for supporting the basin 12 above a supporting surface 13 (FIG. 3), such as a ground surface. Each of the legs 14 preferably extends generally perpendicularly with respect to the planes defined by the bottom wall 12*e* of the basin 12 and the supporting surface 13 when the utility tub 10 is in an assembled configuration (FIGS. 1-3). Each leg 14 preferably includes at least one inwardly extending first projection 22*a* and at least one inwardly extending second projection 22*b*, each of which has a generally flat top surface and an opposing generally flat bottom surface. The second projection 22*b* of each leg 14 is preferably spaced a predetermined distance below the first projection 22*a*.

Each leg 14 preferably has a generally convex exterior surface and an opposing concave interior surface. The interior surface of each leg 14 generally surrounds, engages and/or contacts at least a portion of a periphery of each of the first and second projection 22*a*, 22*b*. Each leg 14 is preferably removeably detachable to at least a portion of the bottom wall 12*e* of the basin 12. More specifically, an upper end 14*a* (see FIG. 4) of each leg 14 may be sized and shaped to engage a complementary receptacle (not shown) formed in an exterior of the bottom wall 12*e* of the base 12, such that the leg 14 and the basin 12 engage by a friction fit, for example. For example, the upper end 14*a* may include a portion formed of a reduced thickness as compared to a the remaining portions of the leg 14, so as more easily fit and/or engage the receptacle of the bottom wall 12*e*. Furthermore, each leg 14 has a first configuration, wherein each leg 14 extends generally perpendicularly with respect to the planes defined by the bottom wall 12*e* of the basin 12 and the supporting surface 13 to support the basin 12 a predetermined distance above the supporting surface 13 (see FIGS. 1-3), and a second configuration, wherein each leg 14 is removed from connection with the bottom wall 12*e* and is sized and shaped to fit entirely within the basin 12 below the upper rim thereof for storage and/or transportation purposes.

At least one and preferable each of the four legs 14 preferably includes a hook 28 extending outwardly from the exterior surface thereof. Each hook 28 is preferably arcuate in shape and extends outwardly and upwardly from the exterior surface of the leg 14. Each hook 28 allows a household and/or commercial item to be hung directly from one of the legs 14. For example, a scrub brush (not shown) having a rope extending from a handle thereof may be hung directly from one of the hooks 28.

As shown in FIGS. 1-5, the utility tub 10 preferably includes a shelf 16 having a first or top surface 16*a* and an opposing second or bottom surface 16*b* (see FIG. 2). The shelf 16 is preferably square or rectangular when viewed from above or below (see FIG. 5), but the shelf 16 is not limited to such a size, shape and/or configuration. The shelf 16 is preferably selectively removably attachable to the basin 12 and to each of the legs 14 such that the shelf 16 has a first configuration, wherein at least a portion of the shelf 16 is supported by the ledge 17 within the basin 12 at a predetermined distance above the bottom wall 12*e* (see FIGS. 1 and 5), and a second configuration wherein at least a portion of the shelf 16 is supported by at least one and preferably all four of the legs 14 at a predetermined distance below the bottom wall 12*e* of the basin 12 (see FIG. 3) and at a predetermined distance above the supporting surface 13.

More specifically, in the second configuration, the bottom surface 16*b* of the shelf 16 preferably rests and/or directly engages the top surface of the second projection 22*b* of at least one and preferable each of the four legs 14. The shelf 16 also preferably includes a third configuration, wherein at least a portion of the shelf 16 is supported by at least one and preferably all four of the legs 14 at a predetermined distance below the bottom wall 12*e* of the basin 12 and above the position of the shelf 16 in a second configuration. In other words, in the third configuration, at least a portion of the bottom surface 16*b* of the shelf 16 rests and/or directly engages the top surface of the first projection 22*a* of at least one of and preferably each of the legs 14. In each of the first, second and third configurations, the shelf 16 preferably defines a plane that extends generally, if not exactly, parallel to the plane defined by the bottom wall 12*e* of the basin 12 and the supporting surface 13.

As shown in FIGS. 1-5, at least one opening 24 extends from the top surface 16*a* of the shelf 16 to the bottom surface 16*b* of the shelf 16 to allow liquid to pass therethrough. In other words, the at least one opening 24 extends completely through the shelf 16. More preferably, the shelf 16 includes a plurality of spaced-apart openings 24 or a predetermined pattern of openings 24 that extend through the shelf 16. The openings 24 are preferably sufficiently large to allow liquid, such as water, to pass easily therethrough. However, the openings 24 are preferably sufficiently small so as not to weaken and/or lessen the structural integrity of the shelf 16 such that the shelf 16 is capable of supporting the weight of household or commercial items thereon and above the supporting surface 13. Furthermore, it is preferred that the openings 24 are preferably located proximate to the geometric center of at least the top surface 16*a* of the shelf 16 and, therefore, spaced inwardly a predetermined distance from the outer periphery of the shelf 16. In other words, it is preferred that none of the openings 24 are located proximate or near the outer periphery of the shelf 16.

Referring specifically to FIG. 4, the shelf 16 preferably includes four spaced-apart corners 26. At least a portion of each corner 26 includes a notch or a recess that extends inwardly toward the geometric center of the shelf 16. In the preferred embodiment, each notch has a generally "L" or "V" shaped such that each notch is preferably sized, shaped and/or configured to receive at least a portion of one of the legs 14 therein when the shelf 16 is in the second and/or third configuration. The notches allow the shelf 16 to be supported by either the first or second projections 22*a*, 22*b* of each leg 14. The notches also allow the shelf 16 to fit more tightly or securely between the legs 14 when the utility tub 10 is in the assembled configuration (FIG. 3), so as to prevent inadvertent laterally movement and even removal of the shelf 16 from between the legs 14.

As shown in each of FIGS. 1-5, utility tub 10 preferably includes a dish 18 for supporting an item a predetermined distance above the bottom wall 12*e* of the basin 12 and proximate the upper rim thereof. The dish 18 may be a soap dish for supporting a bar of soap or a scrubbing or steel wool pad (none shown) at a predetermined distance above the bottom wall 12*e* of the basing 12, but the dish 18 is not so limited. The dish 18 preferably includes a first or top surface 18*a*, an opposing or second bottom surface 18*b* and at least one opening 20 extending completely therethrough. The opening 20 is preferably circular in shape when viewed from above or below and is preferably sized, shaped and/or configured to receive at least a portion of a hose (not shown) therethrough. One end of the hose is preferably removably connectable to at least a portion of the faucet 11, and extends from the faucet 11 to beneath the dish 18, and then above the dish 18 through the opening 20.

As shown in FIG. 4, the dish 18 preferably includes a generally arcuate rear wall 18*c* that extends downwardly below the bottom surface 18*b* thereof and generally perpendicularly thereto. A bottom surface 18*d* of the rear wall 18*c* of the dish 18 preferably contacts and/or directly engages the ledge 17 when the dish 18 is properly positioned within either one of the two adjacent rear corners 19*a* of the basin 12. The two adjacent rear corners 19*a* of the basin 12 are preferably formed on opposing ends of the rear sidewall 12*b* and at least portions thereof have an exaggerated concavity as compared to the two adjacent front corners 19 of the basin 12 (see FIG. 5). The size, shape and/or configuration of the rear wall 18*c* of the dish 18 preferably conforms to an interior of at least one and preferably both of the adjacent rear corners 19*a* of the basin 12, such that the dish 18 is removably mountable within at least one of and preferably either of the two adjacent rear corners 19*a* of the basin 12. However, the dish 18 is preferably not sized and shaped to removably engage the two adjacent front corners 19 of the basin 12.

The combination of the ledge 17 supporting the bottom surface 18*d* of the dish 18 and the generally mating engagement between the rear corners 19*a* of the basin 12 and the arcuate rear wall 18*c* generally holds or maintains the dish 18 in the proper position within either one of the rear corners 19*a* of the basin 12. The removability of the dish 18 from the basin 12 provides versatility to a user and allows the user to selectively configure the utility tub 10 as desired. As shown in FIG. 1, it is possible to place the dish 18 within either one of the two adjacent rear corners 19*a* when the shelf 16 is in the first configuration.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A utility tub comprising:

a basin having a bottom wall and a sidewall extending generally perpendicularly therefrom;

at least two legs for supporting the basin above a supporting surface, each of the at least two legs extending generally perpendicularly with respect to the bottom wall of the basin and the supporting surface; and a shelf including a top surface and an opposing bottom surface, the shelf being selectively removably attachable to the basin and to each of the at least two legs such that the shelf has a first configuration wherein at least a portion of the shelf is supported within the basin above the bottom wall and a second configuration wherein at least a portion of the shelf is supported by the at least two legs below the bottom wall of the basin, wherein the shelf defines a plane that extends generally parallel to a plane defined by the bottom wall of the basin in both the first and second configurations.

2. The utility tub according to claim 1, wherein the basin includes a front sidewall, an opposing rear sidewall, a left sidewall and an opposing right sidewall, each sidewall includes a lower end attached to the bottom wall and an opposing upper end, each pair of adjacent sidewalls forming a corner of the basin, each sidewall including an inwardly extending ledge proximate the upper end thereof, the bottom surface of the shelf contacting at least a portion of the ledge of at least one of the sidewalls when the shelf is in the first configuration.

3. The utility tub according to claim 2, wherein an exterior surface of each of the front, left and right sidewalls of the basin are at least partially concave with respect to a geometric center of the basin.

4. The utility tub according to claim 2, further comprising:

a dish having a top surface, an opposing bottom surface, and at least one opening extending therethrough, the at least one opening being sized and shaped to receive at least a portion of a hose therethrough, the dish being removably mountable within either of at least two of the corners of the basin.

5. The utility tub according to claim 1, wherein each of the at least two legs includes an inwardly extending projection, the bottom surface of the shelf contacting at least a portion of the projection of at least one of the at least two legs when the shelf is in the second configuration.

6. The utility tub according to claim 1, wherein at least one opening extends from the top surface of the shelf to the bottom surface of the shelf to allow liquid to pass therethrough.

7. The utility tub according to claim 1, further comprising:

four spaced-apart legs for supporting the basin above the supporting surface, each leg including an inwardly extending projection, a portion of the bottom surface of the shelf contacting at least a portion of each projection when the shelf is in the second configuration.

8. The utility tub according to claim 7, wherein the shelf includes four spaced-apart corners, each corner defining a notch sized and shaped to receive at least a portion of one of the legs therein when the shelf is in the second configuration.

9. The utility tub according to claim 1, wherein each of the at least two legs is removably attachable to the bottom wall of the basin and each of the at least two legs is sized and shaped to fit entirely within the basin for storage.

10. The utility tub according to claim 1, wherein the shelf includes a third configuration wherein at least a portion of the shelf is supported by the at least two legs below the bottom wall of the basin and above the position of the shelf in the second configuration.

11. The utility tub according to claim 1, wherein at least one of the at least two legs includes a hook extending outwardly from an exterior surface thereof.

12. A utility tub comprising:

a basin including a front sidewall, an opposing rear sidewall, a left sidewall, an opposing right sidewall, and a bottom wall, each sidewall extending generally perpendicularly with respect to the bottom wall, each pair of adjacent sidewalls forming a corner of the basin; and a dish selectively removably mountable within either of at least two of the corners of the basin, the dish having a top surface, an opposing bottom surface, and a rear wall extending generally perpendicularly to the top and bottom surfaces, at least one opening extending through the top and bottom surfaces, the at least one opening being sized and shaped to receive at least a portion of a hose therethrough, and the rear wall being sized and shaped to conform to an interior of at least one of the at least two of the corners of the basin.

13. The utility tub according to claim 12, further comprising:

at least two legs for supporting the basin above a supporting surface, each of the at least two legs having a first configuration wherein each leg extends generally perpendicularly with respect to the bottom wall of the basin and the supporting surface and a second configuration wherein each leg fits entirely within the basin for storage.

14. The utility tub according to claim 13, further comprising:

a shelf including a top surface and an opposing bottom surface, the shelf being selectively removably attachable to the basin and to each of the at least two legs such that the shelf has a first configuration wherein at least a portion of the shelf is supported within the basin above the bottom wall and a second configuration wherein at least a portion of the shelf is supported by at least one of the at least two legs below the bottom wall of the basin.

15. The utility tub according to claim 14, wherein each of the at least two legs includes an inwardly extending projection, the bottom surface of the shelf contacting at least a portion of the projection of at least one of the at least two legs when the shelf is in the second configuration.

16. The utility tub according to claim 13, wherein at least one of the at least two legs includes a hook extending outwardly from an exterior surface thereof.

17. The utility tub according to claim 12, wherein the rear wall of the dish is generally convex to be received within a corresponding concave surface of at least one of the corners of the basin.

* * * * *